United States Patent [19]

Klundt

[11] Patent Number: 4,936,235

[45] Date of Patent: Jun. 26, 1990

[54] SEWING MACHINE WITH AN UPPER TRANSPORT MECHANISM

[75] Inventor: Kurt Klundt, Hirschhorn, Fed. Rep. of Germany

[73] Assignee: Pfaff Industriemaschinen GmbH, Kaiserslautern, Fed. Rep. of Germany

[21] Appl. No.: 224,465

[22] Filed: Jul. 26, 1988

[30] Foreign Application Priority Data

Jul. 27, 1987 [DE] Fed. Rep. of Germany ..... 3724787

[51] Int. Cl.[5] ..... D05B 27/04

[52] U.S. Cl. ..... 112/320; 112/311

[58] Field of Search ..... 112/320, 311, 312

[56] References Cited

U.S. PATENT DOCUMENTS

| | | | |
|---|---|---|---|
| 3,828,704 | 8/1974 | Von Hagen et al. | 112/320 |
| 3,935,826 | 2/1976 | Nicolay et al. | 112/320 |
| 4,116,145 | 9/1978 | Nicolay | 112/320 |
| 4,341,172 | 7/1982 | Thompson | 112/311 X |
| 4,422,398 | 12/1983 | Dusch | 112/320 |

FOREIGN PATENT DOCUMENTS

| | | | |
|---|---|---|---|
| 2620209 | 5/1976 | Fed. Rep. of Germany | 112/320 |

*Primary Examiner*—Andrew M. Falik

*Attorney, Agent, or Firm*—McGlew & Tuttle

[57] ABSTRACT

A sewing machine with an upper transport mechanism includes an arrangement with a pressing foot and a transport foot wherein the mass accelerations due to the movement of these members is reduced. A triangular lever member is provided with lever arms **34*b*, 34*c*** which are linked with the presser foot and upper transport foot. The triangular lever member is linked so as to be angularly movable to an extent of the respective lever arms. Connecting rods of the presser foot and the upper transport foot are connected to the lever arms and are driven thereby. The movement of the connecting rods and the lever arms reduces the mass force of the respective transport foot and the presser foot. To further reduce the mass forces, the upper transport foot and the presser foot are spring loaded with respect to respective carrying elements of the upper transport foot and presser foot so that a damping action occurs.

6 Claims, 3 Drawing Sheets

SEWING MACHINE WITH AN UPPER TRANSPORT MECHANISM

FIELD OF THE INVENTION

BACKGROUND OF THE INVENTION

The invention concerns a sewing machine with an upper transport mechanism and an upper presser foot.

U.S. Pat. No. 4,446,803 discloses a sewing machine of this category in which two sewing feet are controlled by a special gearing configuration in the lifting drive such that they are placed down on or engage with the sewing fabric in a slow manner. This feature is provided to avoid vibrations created by the mass forces present during a hard impact against the sewing fabric. The larger forces of acceleration occasioned by the desired modification of the course of the lifting motion (the slowing or deceleration) however, cause larger mass forces and consequently increased wear on the transmission gearing.

SUMMARY AND OBJECTS OF THE INVENTION

It is an object of the invention to provide a lifting drive for an upper transport mechanism in which both the masses of the transmission elements to be moved and the magnitude of their relative motions are substantially reduced as compared to prior art devices.

According to the invention, a sewing machine is provided with an upper transport mechanism which includes an upper transport foot having a transport foot linkage and a pressing foot having a pressing foot linkage. Both a lifting and a shifting drive unit are provided for the upper transport foot. A linkage arrangement is provided connecting the upper transport foot and the pressing foot. The linkage arrangement includes a triangular lever having one lever arm connected to the linking drive with each of the other lever arms connected via a connection rod to the upper transport foot and the pressing foot, respectively. The other lever arms are angularly positionable to cause movement of the transport foot and the pressing foot respectively. This angular positioning of the lever arms is caused by movement of the triangular lever in a swing out region which encompasses the extended position of the lever arms with their driven connecting rods. In this way, the relative motion of the respective sewing foot is substantially reduced during the phase of being set down on the fabric, and the mass forces which arise are also kept small.

Additionally, the invention provides an arrangement wherein the transport foot is spring suspended to a transport foot carrying element which in turn is connected to a transport foot connecting rod which in turn is connected to the triangular lever. The pressing foot is spring suspended to a pressing foot carrying element which is connected to a pressing foot connecting rod which in turn is connected to the triangular lever. With this feature an alternating conversion between energy of motion (kinetic energy) and spring energy (potential energy) is achieved, so that a portion of the otherwise moved masses is no longer involved in the motion process and, therefore, the mass forces can be further lowered.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

In the drawings:

FIG. 5 is an enlarged view of a triangular lever arrangement according to the invention;

FIGS. 6*a* and 6*b* are enlarged views of end positions upon swing-out of the triangular lever in each of two directions with a medium setting of lift height for the upper transport foot and presser foot; and FIGS. 7*a* and 7*b* are enlarged views of tow end positions of the swing-out of the triangular lever with a setting of maximum lift height for the upper transport foot and presser foot.

DESCRIPTION OF THE PREFERRED EMBODIMENT

Figure 1:
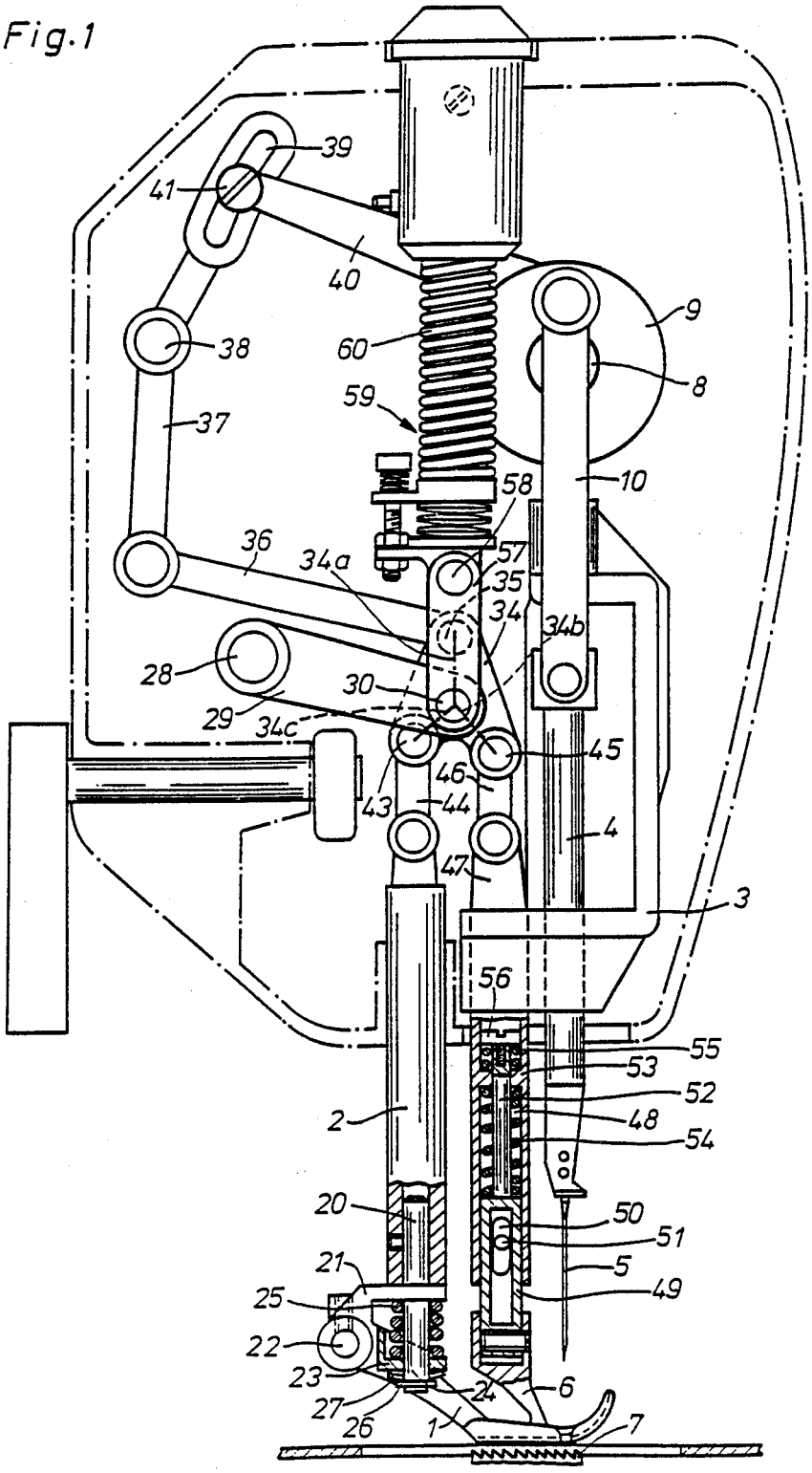
FIG. 1, is a side view of the sewing machine, partly cut away.

FIG. 1 shows the side view of a sewing machine, having a housing shown in phantom. A press bar 2, carrying a presser foot 1, and a needle bar 4 mounted in a needle bar carrier 3 are accommodated in the housing. A thread-guiding needle 5 is connected to needle bar 4 to interact with a shuttle or rotary hook (not shown). In order to push forward the layers of fabric to be joined, the sewing machine has an upper transport foot 6, which interacts with a lower feed or machine fabric feed 7 driven in a known manner.

Figure 2:
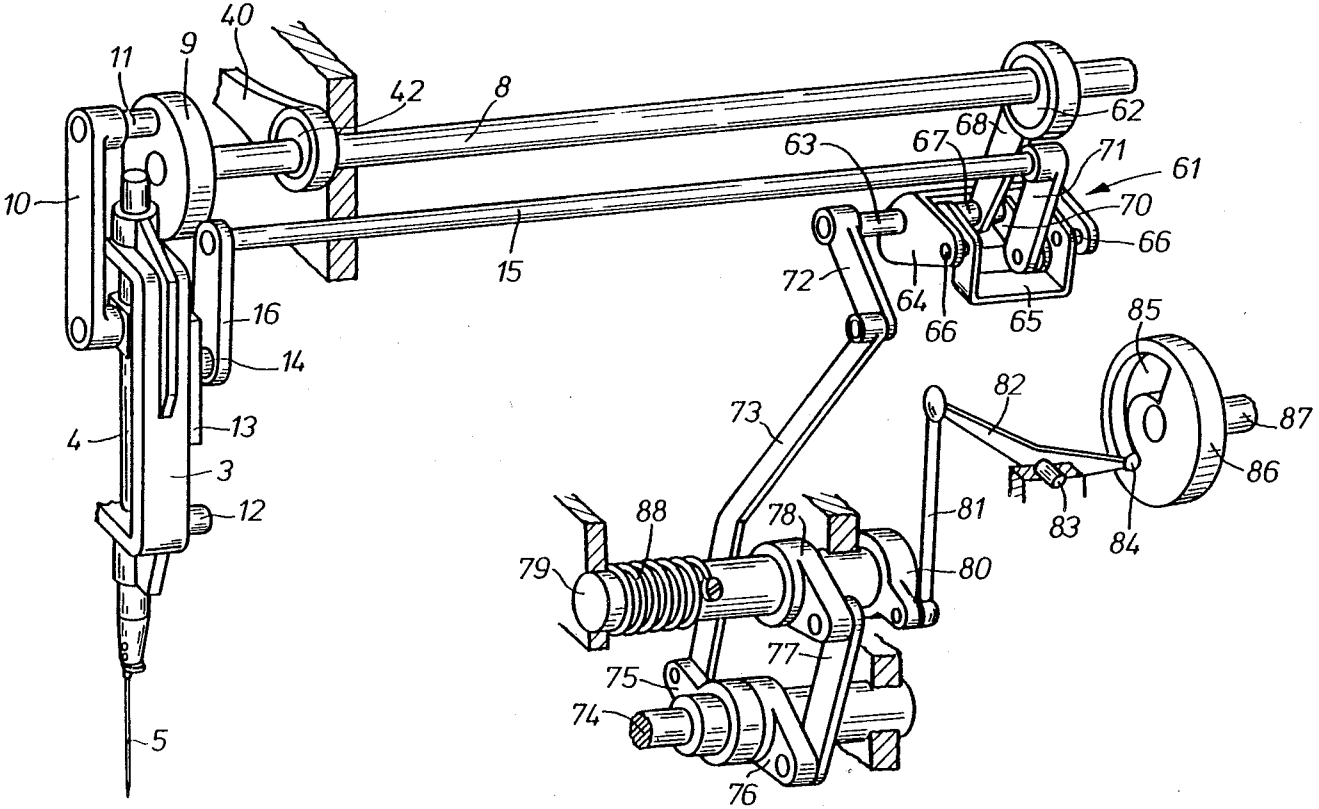
FIG. 2, is a pictorial rendition of the drive elements for the upper transport mechanism and its adjustment.

Also mounted in the housing of the sewing machine is a main shaft 8 (see FIG. 2), likewise driven in a known manner, which drives the needle bar 4 by way of a crank 9 and a connecting rod 10. The connecting rod 10 is mounted on a journal 11, secured in the crank 9.

The needle bar carrier 3 is mounted on a pivot pin 12, fastened in the housing of the sewing machine. On its back side this carries a crank guide 13, into which protrudes a journal 14 of a crank 16, connected to a swinging shaft 15.

In the press bar 2 (see FIG. 1), which is hollowed out at the bottom end, there is fastened a journal 20 of a carrier 21, which is provided with a bearing eye 22 to receive the press foot 1. This is pivoted in the bearing eye 22 and provided with a ring plate 23, which encompasses a downward pointing journal 24, secured to the carrier 21 and extending coaxially with the journal 20. The ring plate 23 is braced by a pressure spring 25 arranged on the journal 24 and by a spring wash 27, buttressed against a retaining washer 26 on the end of the journal 24.

On a journal 28 secured in the housing there is mounted an arm 29, carrying a bolt 30, on which is mounted a triangular lever 34. This arrangement provides three lever arms (34*a*, 34*b*, 34*c*), indicated by broken lines, of which one has an end at the location triangular lever 34 is joined by a bolt 35 to a coupling 36. This is connected to a double lever 37, mounted on a journal 38 secured to the housing. The double lever 37 has an arm with a curved lengthwise slot 39. In this slot, the point of articulation of eccentric rod 40 can be adjusted by loosening a collar screw 41. The eccentric rod 40 (see FIG. 2) clasps a cam 42, fastened on the main shaft 8.

The third lever arm 34*c* (see FIG. 1) has an end at the location the triangular lever 34 is connected by a journal 43 to a jointed butt strap or connecting rod 44, which in turn is hinged to the press bar 2, movably mounted in the housing.

The second lever arm 34*b* has an end at the location the triangular lever 34 is connected by a journal 45 to a jointed butt strap or connecting rod 46, which is hinged to an upper transport bar 47, movably mounted in the needle bar carrier 3. The lever arms 34and 34*c* of the triangular lever 34 are arranged with respect to the driven lever arm 34*a* in such an angular position that the extended position of the lever arrangement 34*b*, 46; 34*c*, 44 is achieved even at slight movement of the driven lever arm 34*a*. At a larger driving movement, this extended position is surpassed or crossed over.

The upper transport bar 47 has a bore 48, in which a bar element 49 is inserted. At the lower end of this, the upper transport foot 6 is secured. The bar element 49 is provided with a lengthwise hole 50, through which is passed a pin 51, transversely secured in the upper transport bar 47. A journal 52, joined to the bar element 49 as an axial extension thereof, is inserted in an inner shoulder 53 of the bore 48. Mounted on the journal 52 is a spring 54 between the bar element 49 and the inner shoulder 53. A second spring 55 is arranged between the inner shoulder 53 and a screw 56, screwed into the upper end of the journal 52. The springs 54 and 55 retain the upper transport foot 6 in a predetermined middle position.

The hinge pin 30 is connected to a journal 58 of a carrying system 59 by a pair of butt straps 57, of which only the front butt strap can be discerned. This system is secured in the housing of the sewing machine and, along with a pressure spring 60 and other elements, acts on the upper transport foot 6 and the presser foot 1. A more detailed description of the carrying system 59 will be found in DE-OS (patent application No. 3724786.

The pushing drive of the upper transport foot 6 comes from a stitch guide 61 (FIG. 2), which is connected to a cam 62, secured on the main shaft 8. The stitch guide 61 has a positioning shaft 63, mounted in the housing, which is firmly joined to a shackle 64, between the arms of which a second shackle 65 is pivoted by trunnions 66. The arms of the shackle 65 are joined by a bolt 67, on which an eccentric rod 68 is hinged. The cam 62, embraced by the eccentric rod 68, imparts to the bolt 67 oscillatory motions about the trunnions 66.

A coupling 70, engaging with the bolt 67 at one end, is hinged at the other end to a lever arm 71, which is secured at one end of the swinging shaft 15, mounted in the housing parallel with the main shaft 8.

On the positioning shaft 63 of the stitch guide 61 is secured a lever arm 72, which is connected by a coupling 73 to a crank 75, fastened on a positioning shaft 74.

On the positioning shaft 74, mounted in the housing, is clamped a positioning crank 76, which is connected to an intermediate shaft 79, mounted in the housing, across a link 77 and a second positioning crank 78. On the intermediate shaft 79 is secured a lever 80. The lever 80 is connected by a ball-ended tie rod 81 to one end of a swinging lever 82, which can swivel around an axis 83 fastened in the housing. The remaining free end of the swinging lever 82 has a ball-shaped extension piece 84 and protrudes into a positioning curve 85 of a locking adjustment wheel 86, which is arranged on an axis 87 secured to the housing. The positioning curve 85 in the adjustment wheel 86 extends in a spiral relative to the axis thereof, such that stitch lengths of the 1 to 6 mm, for example, can be set on the upper transport foot 6. A spring 88, embracing the intermediate shaft 79 and secured in the housing at one end, constantly holds the extension piece 84 of the swinging lever 82 against one of the side walls of the positioning curve 85.

The positioning shaft 74 is connected to the lower feeder 7 in a manner not shown, such that a displacement of the adjustment wheel 86 entails a synchronous adjustment of both the upper transport foot 6 and the lower feeder 7.

The mechanism operates as follows:

The size of the feed of the upper transport foot 6 (FIGS. 1 and 2) is set by turning the adjustment wheel 86, whereupon the positioning curve 85 correspondingly turns the intermediate shaft 79 via the swinging lever 82. The intermediate shaft 79, across the link 77, thereupon displaces the positioning shaft 74 and, across the coupling 73 and the lever arm 72, the positioning shaft 63.

Through this arrangement, when the adjustment wheel 86 is displaced the feed setting of the upper transport foot 6 is changed in synchronization with the feed setting of the lower feeder 7, which can be adjusted by the positioning shaft 74.

The motion obtained from the cam 62 is transmitted across the drive linkage—eccentric rod 68, bolt 67, coupling 70, lever arm 71, swinging shaft 15 and crank 16—to the needle bar carrier 3, which thereby imparts to the needle bar 4 and the upper transport bar 47 a corresponding swinging motion, which brings about the feeding motion of the needle 5 and of the upper transport foot 6.

In synchronization with the feeding motion of the upper transport foot 6, the motion derived from the cam 42 driven by the main shaft 8 is transmitted across the drive linkage—eccentric rod 40, double lever 37, coupling 36—to the triangular lever 34. This is turned about the hinge pin 30, which is controlled by the arm 29, mounted firmly in the housing.

By the rotary oscillation of the triangular lever 34, the up and down motion of the two sewing feet (upper transport foot 6 and press foot 1), and, consequently, their pressure acting on the sewing fabric, is achieved. The pressing force is dictated by the pressure of the springs 25 and 54 of the two sewing feet and the pressure via the carrying system 59, as shall be explained in greater detail below.

The carrying system 59 acts with a force determined by the pressure spring 60 via the pair of butt straps 57 on the bolt 30 and, thus, also on the triangular lever 34. From this, the force is conveyed, depending on the swinging position of the triangular lever 34, to one or both of the sewing feet (upper transport foot 6 and press foot 1). The two springs 25 and 54 serve as working springs. These are compressed, either individually or both together with corresponding intensity, and press the sewing feet with a predetermined pressing force against the sewing fabric. The springs 27 and 55 are stop springs, to avoid rebound percussions during the lifting process of the particular sewing foot.

During the operation of the sewing machine, a mean value of the impulsive forces of reaction acting on the sewing feet is achieved. This mean value is transmitted via the pair of butt straps 57 to the carrying system 59. The intensely impulsive forces of reaction arising on the two sewing feet produce rhythmical impulses of motion on the carrying system 59. By virtue of the specific configuration of the latter, the impulses of motion are heavily dampened, so that it remains relatively rigid under unchanged sewing conditions and only the sewing feet themselves execute an up and down motion. The height of the stroke of the sewing feet can be adjusted by changing the effective length of the upper lever arm of the double lever 37 through a changing of the point of articulation of the eccentric rod 40 in the lengthwise slot 39.

The swinging motions of the lever arms **34*b* and 34*c* resulting from the rotary oscillation of the triangular lever 34, even at a low setting of the lifting drive, produce a flattening of the amplitude of the stroke of the two sewing feet 1 and 6 when the sewing feet 1 and 6 are placed down on the fabric, since the two lever arms 34*b* and 34*c* will be operating in the region of their extended position with the corresponding jointed butt straps 44 and 46**.

Figure 3:
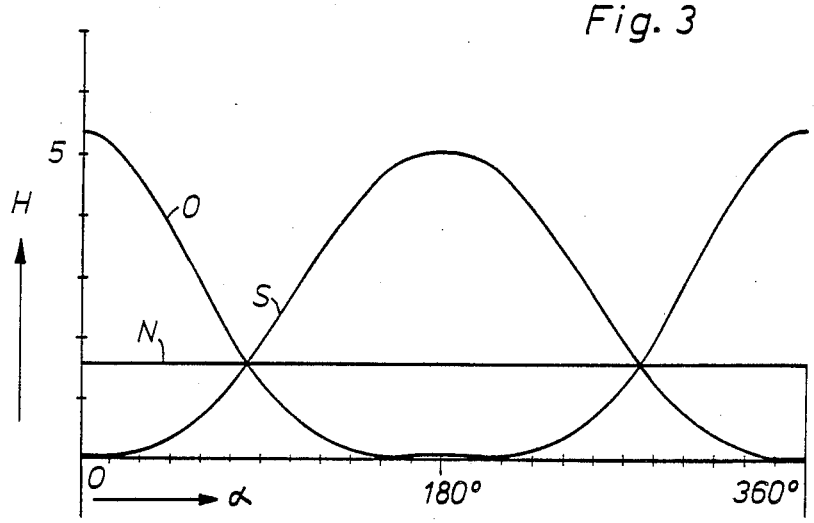
FIG. 3, is a stroke-path diagram of upper transport foot and presser foot at middle lift height.

FIGS. **6*a* and 6*b* show two end positions of the triangular lever 34 during its oscillation at a medium lift height setting. This provides a range of positions defined by the angle between the lever arm 34*c* and the corresponding butt strap 44 and between lever arm 34*b* and corresponding butt strap 46. In this range of movement, movement of the lever arms 34*c* and 34*b* generate a relatively great stroke movement of the presser foot 1 and of the top feed foot 6 for a given swing-out of triangular lever 34. As the triangular lever 34 rotates further, the lever arms 34*c* or 34*b* form an angle with associated butt strap 44 and 46, respectively, of 180° or more (FIG. 7*a* shows a 180° angle between lever 34*c* and butt strap 44 and FIG. 7*b* shows an angle between lever arm 34*b* and butt strap 46 which exceeds 180°). In the range of movement through the 180° point, the movement of the triangular lever arms 34*c* and 34*b* produce only a very small stroke movement of the presser foot 1 or the top feed foot 6. Indeed, as soon as the angle enclosed between the corresponding arm 34*c* and 34*b* and the associated butt strap 44 or 46 exceeds a value of 180°, due to the rotary movement of the triangular lever 34, an oppositely directed stroke movement is actually applied to the presser foot 1 or the top feed foot 6. (See FIG. 7*b*). In the diagram of FIG. 3, the surface of the sewing fabric is designated by N, the theoretical lifting motion of the press foot 1 by S, and the theoretical lifting motion of the upper transport foot 6 in relation to the angular rotation (alpha) of the main shaft 8 and the lifting height H is indicated by 0. It will be seen that the magnitude of the stroke of both sewing feet below line N has a much flatter trend than the magnitude of stroke above line N. In actuality, the press foot 1 and the upper transport foot 6 descend only to line N. Their further downward motion is then quickly intercepted as increased force energy by the particular springs 25 or 54**.

Figure 4:
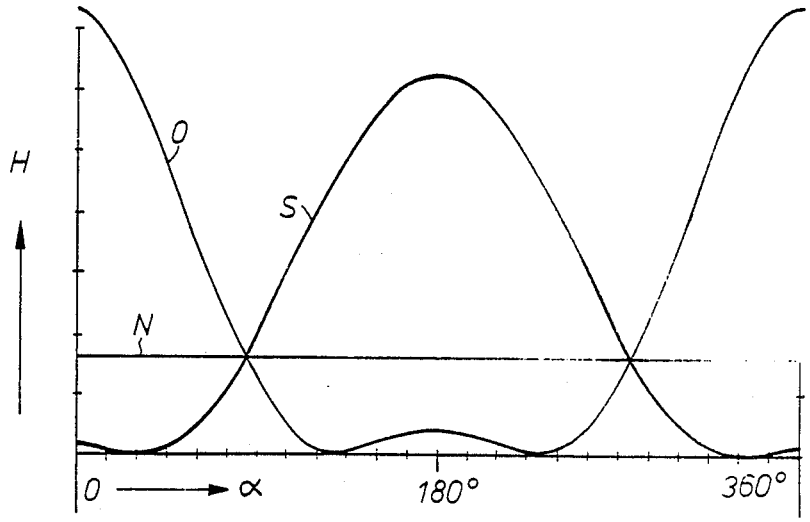
FIG. 4, is a stroke-path diagram of upper transport foot and presser foot at maximum adjusted lift height.

At larger stroke setting, the triangular lever 34 executes a larger swinging motion, so that the two lever arms **34*b* and 34*c* are also swiveled further beyond their extended or stretched positions. The result, as shown in FIG. 4, is indentations in the lower region of the two stroke movements 0 and S. That is, upon a pivoting of the lever or upon a swivelling motion of the triangular lever 34, one of the arms 34*b* and 34*c* is moved into a position in which the lever arm forms an angle of nearly 180° with its corresponding butt strap 44 or 46. Upon additional rotary movement of the triangular lever 34, the corresponding lever arm 34*c* or 34*b* is moved with its corresponding butt strap 44 or 46 beyond an angle of 180° (greater than an angle of 180°), so that the distance between the bolt 30 of the triangular lever 34 and the presser foot 1 or of the top feed foot 6 actually decreases again somewhat. In the case of the top feed foot 6, this measure corresponds with the lifting movement of the feed dog 7 as a result of which the lifting movement of the feed dog 7** is not transmitted further to the lifting system.

After the swivelling movement of the triangular lever 34 has reached its end state (end of swing-out), the above-described movements of the presser foot 1 and of the top feed stroke 6 take place in the reverse sequence during the swivelling back of the triangular lever 34. This prevents an increased distribution of the stroke, during the setdown phase to the particular sewing foot 1 or 6. Furthermore, a portion of the stroke of the feeder 7 acting on the sewing fabric during this phase is taken up by the now-important deflection of the upper transport foot 6, resulting from the lever arm **34*b* overshooting its extended position with the jointed butt strap 44**.

By using a transmission, spring-loaded in both directions, between the press foot 1 and the upper transport foot 6, on the one hand, and their respective carrier bars (press bar 2 and upper transport bar 47), on the other, very slight masses in motion are produced during normal sewing processes, resulting from the mutual lifting motion of the two sewing feet 1 and 6, while the lift exerted by the feeder 7 on the upper transport foot 6 is perceived as a momentary increase in tension of the spring 54.

While a specific embodiment of the invention has been shown and described in detail to illustrate the application of the principals of the invention, it will be understood that the invention may be embodied otherwise without departing from such principals.

What is claimed is:

1. A sewing machine with an upper transport mechanism comprising: an upper transport foot assembly including an upper transport foot; a presser foot assembly including a presser foot; a reciprocating drive unit; and, a linkage assembly including a triangular lever member mounted on a substantially centrally located pivot, the centrally located pivot being fastened on one end of a lever, the lever having another end fastened to a housing of the sewing machine, said triangular lever member having a first lever arm connected to said reciprocating drive unit, a second lever arm connected to said upper transport foot assembly via a transport foot connecting rod and a third lever arm connected to said presser foot assembly via a presser foot connecting rod, said triangular lever being angularly movable by said reciprocating drive unit in a predetermined swing out region, the second and third lever arms being defined at an angle which is dimensioned with respect to the substantially central pivot such that an angle of 180° is formed between the second and third lever arms and the respective corresponding connecting rod during movement of the triangular lever within the predetermined swing-out region.

2. A sewing machine according to claim 1, wherein: said upper transport foot assembly includes a transport foot carrying element, said upper transport foot being connected to said transport foot carrying element by spring suspension means for providing a spring suspension between said transport foot and said transport foot carrying element for dampening forces between said carrying element and said transport foot, said transport foot carrying element being connected to said transport foot connecting rod, said presser foot assembly including a presser foot carrying element, said presser foot being connected to said presser foot carrying element by presser foot spring suspension means for connecting said presser foot to said presser foot carrying element for dampening forces between said presser foot carrying element and said presser foot, said presser foot carrying element being connected to said presser foot connecting rod.

3. A sewing machine according to claim 1, wherein each of the upper transport foot and the presser foot includes a double spring set arranged to hold the upper transport foot and presser foot respectively in a central position and to resist upward and downward movement.

4. A sewing machine with an upper transport mechanism comprising: an upper transport foot assembly, said upper transport foot assembly having an upper transport foot carrying element, an upper transport foot spring suspension member and an upper transport foot, said upper transport foot being spring suspended to said upper transport foot carrying element by said upper transport foot spring suspension member; a presser foot assembly including a presser foot carrying element, a presser foot spring member and a presser foot, said presser foot being spring suspended to said presser foot carrying element by said presser foot spring member; a reciprocating drive unit; and, a linkage assembly including a triangular lever member defining a first lever arm connected to said reciprocating drive unit, a second lever arm connected to said upper transport foot carrying element via a transport foot connecting rod, and a third lever arm connected to said presser foot carrying element via a presser foot connecting rod, said first, second and third lever arms being connected at a triangular lever member pivot, said triangular lever member being angularly movable by said reciprocating drive unit about said triangular lever member pivot in a predetermined swing out region, said swing out region extending in one direction beyond a point at which an angle of 180° is formed between the second and third lever arms and the respective corresponding connecting rod.

5. A sewing machine according to claim 4, wherein: said presser foot carrying element includes a hollow portion adapted to receive a journal connected to said presser foot, said transport foot carrying element including a hollow portion for receiving a transport foot spring.

6. A sewing machine with an upper transport mechanism comprising:

an upper transport foot assembly, including an upper transport foot and an upper transport foot carrying element;

a presser foot assembly including a presser foot and a presser foot carrying element;

a shifting drive unit providing a reciprocating shifting motion; and linkage assembly means including a triangular lever member defining a first lever arm connected to said shifting drive unit, a second lever arm connected to said upper transport foot carrying element via a transport foot connecting rod, a third lever arm connected to said presser foot carrying element via a presser foot connecting rod, said first, second and third lever arms intersecting at a triangular lever member pivot, said pivot being fastened on one end of a lever, the lever having another end fastened to a housing of the sewing machine, said triangular lever member being angularly movable for movement in a predetermined swing out region by said shifting device unit about said triangular lever member pivot for moving each of said upper transport foot and said presser foot downwardly a maximum amount and upwardly an amount during angular movement of said triangular lever member in an upper transport foot direction and a presser foot direction respectively in said predetermined swing out region to dampen the upward and downward movement of each of said upper transport foot and presser foot.

* * * * *